United States Patent [19]

Wise

[11] 3,930,348

[45] Jan. 6, 1976

[54] REINFORCED CONCRETE CONSTRUCTION

[75] Inventor: Harry H. Wise, Belle Mead, N.J.

[73] Assignee: Johns-Manville Corporation, Denver, Colo.

[22] Filed: Sept. 10, 1973

[21] Appl. No.: 395,778

Related U.S. Application Data

[63] Continuation-in-part of Ser. No. 2,924, Jan. 14, 1970, Pat. No. 3,763,613.

[52] U.S. Cl. ..... 52/600; 52/447

[51] Int. Cl.[2] ..... E04B 5/52

[58] Field of Search ..... 52/583, 447, 587, 387, 52/334, 598, 604, 690, 693, 694, 338, 339, 340, 341, 320, 723, 8

[56] References Cited

UNITED STATES PATENTS

| | | | |
|---|---|---|---|
| 1,150,044 | 8/1915 | Leonard | 52/583 |
| 2,037,465 | 4/1936 | Gibson | 52/587 |
| 2,125,516 | 8/1938 | Neumeister | 52/447 |
| 3,763,613 | 10/1973 | Wise | 52/447 |

FOREIGN PATENTS OR APPLICATIONS

| | | | |
|---|---|---|---|
| 356,898 | 10/1961 | Switzerland | 52/612 |
| 803,427 | 4/1951 | Germany | 52/432 |
| 80,448 | 4/1920 | Austria | 52/338 |
| 1,465,570 | 12/1966 | France | 52/600 |

*Primary Examiner*—John E. Murtagh
*Attorney, Agent, or Firm*—Robert M. Krone; James W. McClain

[57] ABSTRACT

There are disclosed methods of splicing reinforcement across joints of pre-cast reinforced concrete sub-slabs for integrating such sub-slabs to define the underside layer of composite concrete continuously reinforced slabs formed without separate formwork other than shoring for the sub-slabs to define continuously reinforced spans and two-way flat plates, sub-slabs for use therein, joints formed thereby and building structures formed thereby.

2 Claims, 14 Drawing Figures

REINFORCED CONCRETE CONSTRUCTION

This application is a continuation-in-part of my copending application Ser. No. 2,924 filed Jan. 14, 1970, now U.S. Pat. No. 3,763,613 granted Oct. 9, 1973 and the entire and complete disclosure thereof is hereby expressly incorporated herein as completely and fully as if physically reproduced hereat.

The present invention relates to reinforced concrete construction and finds particular utility when applied as a method and means of building two-way slabs and flat slabs often referred to as "flat plates".

The present invention may be used, for example, but without limitation, to produce reinforced concrete floors and roofs employing composite concrete flexural construction and the method and means hereof require little or no formwork, greatly reduce the use of temporary stringers and shores, increase the speed of construction, reduce the number of skilled workmen on the job and materially reduce the over-all cost of construction.

In conventional building constructions employing concrete floors, such floors are formed with the aid of so-called falsework or formwork which is generally made up from horizontal boards or plates supported by stringers and shores, placed at various points along their length and width. After the formwork has been built, prefabricated reinforcement is laid within the formwork and fixed into a predetermined desired position. Finally, the concrete is poured over the reinforcement into the formwork and the formwork remains in place until the concrete has set, solidified and gained sufficient strength to carry itself. In the meantime, the space beneath the floor is cluttered up with the many shores and is unusable during the entire building period.

This method of construction is very inefficient and expensive. The formwork is elaborate and time consuming to erect and later to remove, needing fairly skilled workmen and a large crew of workers. Furthermore, all construction trades must cease their work on the floor below until the formwork is removed. Additionally, the formwork may be a fire hazard, since it is often made of wood.

Rapidly increasing costs of construction, combined with continuous labor shortages and inevitable risk of delay due to weather conditions, have generated an increasing interest in prefabrication as a tool looking toward a more economical and efficient structure. While many systems employing prefabrication have been developed in recent years, only a few have found limited practical application. In many instances the prior attempts have been so complex that they outweigh the usefulness of the systems.

The present invention has as its object to make it possible to construct reinforced concrete slabs in a feasible, more rapid and economical manner without the need for the elaborate formwork employed in the conventional concrete slab constructions.

This is accomplished according to the invention, with the aid of a thin prefabricated or pre-cast panel containing the bottom reinforcing of the flat plate upon which there is applied, on the slab site, further reinforcing and a poured in place concrete topping to provide a multilayer construction of one or various materials joined together to prevent any slippage or separation of the layers and to thereby act and function as a monolithic unit.

The flat plate or flat slab concrete construction is of relatively recent origin, having been invented only about the beginning of the 20th century and permitted, for the first time, floors to be built without beams or girders with simple form work and reinforcing steel with a reduction in the need for skilled labor. Flat plate construction offers finished flat ceilings, saves headroom and allows maximum freedom in planning building space. Initially, the system was referred to as the "girderless floor", only the name "flat plate" having been adopted, and quickly it became a most desirable system for many buildings in the United States.

In "Flat Plate" construction, a reinforced concrete slab of substantially uniform thickness is supported on a generally square matrix or array of supporting columns as opposed to conventional construction wherein a thinner floor panel is supported on a series of generally parallel beams or beam sections. In conventional construction, therefore, the floor panels themselves are substantially unloaded in the direction parallel the beams, and are loaded only perpendicular or between the beams. In flat plate construction, on the other hand, the flat plate is divided by the supporting columns into generally square regions supported only at the corners where the plate passes over or through the columns and the plate is loaded in mutually perpendicular direction generally parallel each of the sides of such square regions. Further, the type of loading varies across such regions, the upper surface of the plate being in tension generally adjacent the columns and in compression generally intermediate thereof while the lower surface is in compression generally adjacent the columns and in tension generally intermediate thereof. Since reinforced concrete developes compressive strength generally in the concrete and tensile strength generally in the reinforcement, it is clear that it is critical to flat plate construction to provide continuity of reinforcement along the lower surface intermediate the columns.

Two-way reinforced concrete slabs or flat plates therefor employ the principle of reinforcing the slab in two transverse directions as opposed to supporting a floor on generally parallel beams.

In accordance with the present invention, the bottom layer of the composite concrete floor or plate is formed by using a plurality of thin prefabricated concrete panels of considerable length spanning the columns and of a width less that the distance between columns, in the neighborhood of around 8 feet or so to enable transport to the job site, slid side by side in place on the job site with their ends resting on temporary or permanent supports. The panels are precast and furnished to the job site with the lower reinforcement complete, as by being cast with one or more lattice-type girders or trusses extending lengthwise of each panel having their bottom chords firmly embedded in the panel to define the lower longitudinal reinforcement and with the webbing and top chords (which defines the upper longitudinal reinforcement) extending above the top surface of the panel to afford completed longitudinal reinforcement in a longitudinal direction from support to support. Transverse reinforcing of the panels is obtained by embedding a plurality of transversely disposed reinforcing rods or bars in the precast panels during the casting thereof with the ends of said rods or bars being formed with special upwardly extending return bend hooks which protrude above the upper surface of the panels adjacent the marginal edges thereof, and which may subsequently be joined by the employment of a special splicing means to afford continuity of transverse lower reinforcement from panel to panel. The upper transverse reinforcement is layed in place and tied across the top chords after positioning of the pre-cast slabs during erection. The splice is completed and the continuation of transverse reinforcement obtained when the concrete topping applied on the site completely embeds the hooks, splicing link, trusses and upper transverse reinforcement and has cured and set to form the composite concrete floor slab.

In accordance with one aspect of the invention, a plurality of elongated sub-slabs pre-cast to span fixed supports in one direction are laid side by side between the supports and are transversely integrated in accordance with the present invention into a two-way flat plate structurably equivalent to a cast-in-place plate formed against conventional formwork. To provide such structural equivalence, lattice-type girders or trusses may be incorporated extending longitudinally of the pre-cast sub-slabs with the bottom chords embedded in the sub-slab and with the top chords extending above the top surface of the sub-slab to afford reinforcement in a longitudinal direction from fixed support to fixed support. Transverse reinforcing of the plate is obtained by embedding a plurality of transversely disposed reinforcing rods or bars in the pre-cast sub-slabs with the end portions thereof extending outwardly of the sub-slabs adjacent the edge thereof for splicing in accordance with the present invention to provide integrated lower transverse reinforcement equal to the transverse lower reinforcement of conventional cast-in-place plate construction. The upper transverse reinforcement may be laid across the girder top chords after positioning of the sub-slabs and the entire plate is completed and integrated by casting in place of concrete onto and against the sub-slabs to bond therewith and embed the top chords, top transverse reinforcement and lower transverse reinforcement splices.

In the present invention, reinforcing in the longitudinal direction of the pre-cast sub-slabs runs continuously from support to support and is achieved by casting an adequate amount of bars and trusses in the pre-cast slabs. The reinforcing in the transverse direction is cast into the pre-cast slabs in a length equal to the width of the slabs, and by splicing in the field, is made continuous. In the present invention, a special method of splicing has been developed to enable such transverse reinforcement across the joints between sub-slabs to be made economically.

In accordance with the present invention, the side edges of the sub-slabs may be perpendicular the lower surface with the lower transverse reinforcement bars being formed with upwardly extending return bend hooks protruding above the upper surface of the sub-slabs inwardly of the marginal edge thereof enabling adjacent sub-slabs to be tightly abutted for development of the full compressive strength of the concrete through the joint and enabling the sub-slabs to support the concrete cast in place thereon as fully and completely as conventional formwork.

The splicing of the lower transverse reinforcement is completed above the upper surface of the sub-slabs but yet, in accordance with the teachings and techniques of the present invention and the novel splices hereof, enables integration of the lower transverse reinforcement to enable development of full tensile strength through the joints and the production of a full structural equivalent of a fully conventionally cast-in-place plate.

Bearing in mind the foregoing, it is the primary object of the present invention to provide novel and improved methods and apparatus for reinforced concrete construction.

Another primary object of the present invention, in addition to the foregoing object, is the provision of novel and improved methods and apparatus for reinforced concrete construction without the use of conventional formwork.

Another primary object of the present invention, in addition to each of the foregoing objects, is the provision of novel and improved methods and apparatus for reinforced concrete flat plate construction.

Yet another primary object of the present invention, in addition to each of the foregoing objects, is the provision of novel and improved methods and apparatus for reinforced concrete construction using prefabricated sub-slabs and poured-in-place topping thereon.

Yet another primary object of the present invention, in addition to each of the foregoing objects, is the provision of novel methods and apparatus of reinforcing concrete construction whereby a plurality of prefabricated sub-slabs are integrated into a poured-in-place topping layer to define a reinforced concrete slab or flat plate structurally equivalent to a conventionally fully cast-in-place structure.

Yet another primary object of the present invention, in addition to each of the foregoing objects, is the provision of novel and improved methods and apparatus for splicing reinforcement for reinforced concrete construction.

Yet still another object of the present invention, in addition to each of the foregoing objects, is the provision of novel and improved methods and apparatus of integrating reinforcement of a plurality of prefabricated reinforced concrete components.

Another and further primary object of the present invention, in addition to each of the foregoing objects, is the provision of novel and improved methods and apparatus for splicing reinforcement for reinforced concrete construction.

Yet still another object of the present invention, in addition to each of the foregoing objects, is the provision of novel and improved methods and apparatus of integrating reinforcement of a plurality of prefabricated reinforced concrete components.

Another and further primary object of the present invention, in addition to each of the foregoing objects, is the provision of novel and improved methods and apparatus of economically and efficiently producing reinforced concrete two-way slabs or flat plates.

Another and still further primary object of the present invention, in addition to each of the foregoing objects, is the provision of novel and improved methods and apparatus for incorporating prefabricated reinforced concrete structural elements across the joints therebetween.

It is a yet still further primary object of the present invention, in addition to each of the foregoing objects, to provide novel and improved methods and apparatus of reinforced concrete building construction wherein a plurality of prefabricated sub-slabs containing bottom reinforcement elements are temporarily shored in position, the reinforcement thereof extending across the joints therebetween, top reinforcement is conventionally placed there above and concrete poured thereon to embed the top reinforcement and splicing elements to provide the structural equivalent of a fully poured-in-place structure without the use of formwork.

Yet another and still further primary object of the present invention, in addition to each of the foregoing objects, is the provision of novel and improved methods and apparatus for reinforced concrete building construction utilizing prefabricated reinforced concrete sub-slabs in place of conventional formwork.

It is a yet still further primary object of the present invention, in addition to each of the foregoing objects, to provide novel and improved methods and apparatus of reinforced concrete building construction incorporating novel and improved splicing methods and apparatus for reinforcement thereof capable of supporting both compression and tensile stresses.

It is a yet still further primary object of the present invention, in addition to each of the foregoing objects, to provide novel and improved methods of splicing reinforcement in concrete construction in a plane offset to the plane of the reinforcement and converting tensile forces within the splice zone to compressive stress to provide the structural equivalent of continuous reinforcement thereacross.

It is a still further primary object of the present invention, in addition to each of the foregoing objects, to provide reinforced concrete sub-slabs usable as both a form and as part of a finished reinforced concrete plate.

A yet still further primary object of the present invention, in addition to each of the foregoing objects, is to prefabricate the underside layer of the floor slab with all the bottom reinforcing in place as a separate thin precast panel, employ these panels on the side as formwork, and after adding the upper portion of the slab on the site, end up with a composite floor or ceiling slab. This invention therefore creates an alliance of precast and poured-in-place techniques and methods of construction, employing the most desirable and beneficial features of both.

It is still another and further primary object of the present invention, in addition to each of the foregoing objects, to provide novel and improved methods and apparatus for thin permanent precast reinforced concrete forms capable of taking a cast-in-place concrete decking for a wide range of floor and roof requirements.

It is still another and further primary object of the present invention, in addition to each of the foregoing objects, to provide novel and improved methods and apparatus for sub-slabs finished on the underside surface, ready to paint, due to pre-casting in steel forms, for incorporation into the lower portion of a reinforced concrete plate.

It is a feature of the present invention that reinforced concrete plates and two-way reinforced slab building constructions may be fabricated rapidly, economically and efficiently, functionally equivalent to conventionally poured-in-place concrete construction with substantially reduced labor and particularly skilled labor requirements.

It is a further feature of the present invention that it provides a system for producing two-way action behavior in floor slabs and plates made of reinforced concrete, and a means of a construction system whereby such flexural behavior and performance can be achieved with due regard to requirements of recognized national building codes for reinforced concrete in the United States.

It is a yet further feature of the present invention that applicant's panel system accepts significant positive and negative bending moments and shear forces across both longitudinal and transverse joints away from columns or beams. In other words, the particular combination of elements employed in the flat slab structure, including the novel splicing joint, results in the structure being capable of adequately supporting the load and accepting the positive and negative bending moments and shear forces that will be produced transversely of the panel elements, all without any supporting columns or beams beneath the line of the splicing connections.

Another and still further feature of the present precast panel system is its ability to accept significant positive and negative bending moments and shear forces across both longitudinal and transverse joints away from columns or girders. The arrangement of the panel joints in the attached photograph clearly shows this. After the removal of the construction shoring, high positive and negative bending moments and shears will be produced transverse to the main axis of the panels; these must be accepted by the joining system.

The present invention resides in the combination, construction, arrangement and disposition of the various component parts and elements incorporated in improved reinforced concrete construction in accordance with the principles of this invention. The present invention will be better understood and objects and important features other than those specifically enumerated above will become apparent when consideration is given to the following details and description, which when taken in conjunction with the annexed drawing describes, discloses, illustrates and shows a preferred embodiment or modification of the present invention and what is presently considered and believed to be the best mode of practicing the principles thereof. Other embodiments or modification may be suggested to those having the benefit of the teachings herein, and such other embodiments or modifications are intended to be reserved, especially if they fall within the scope and spirit of the subjoined claims.

IN THE DRAWING

Like reference characters are used throughout the following corresponding parts.

Figure 1:
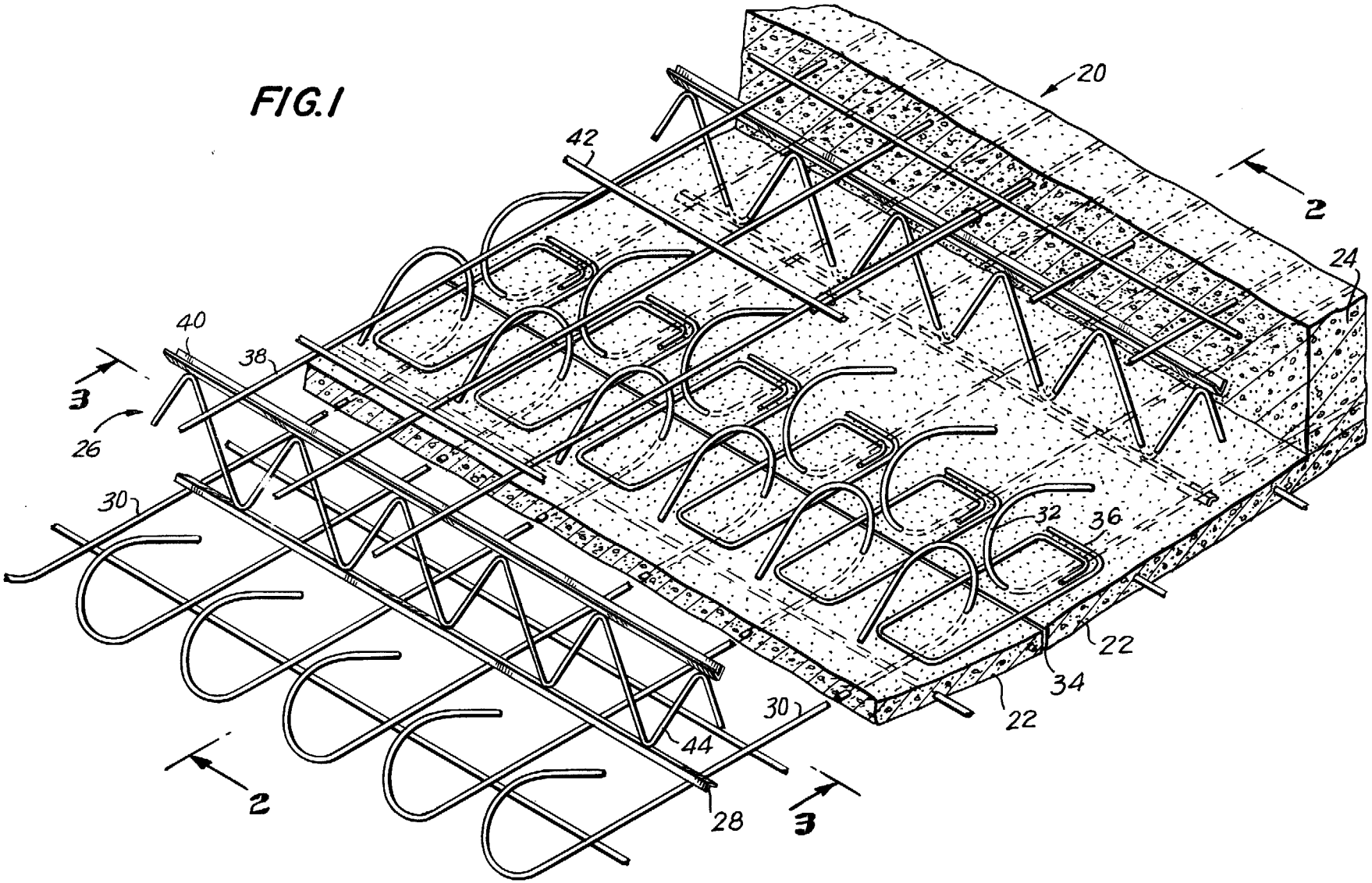
FIG. 1 is a perspective illustration, partially broken away, of a portion of a reinforced concrete plate or two-way flat slab constructed in accordance with the present invention.
Figure 2:
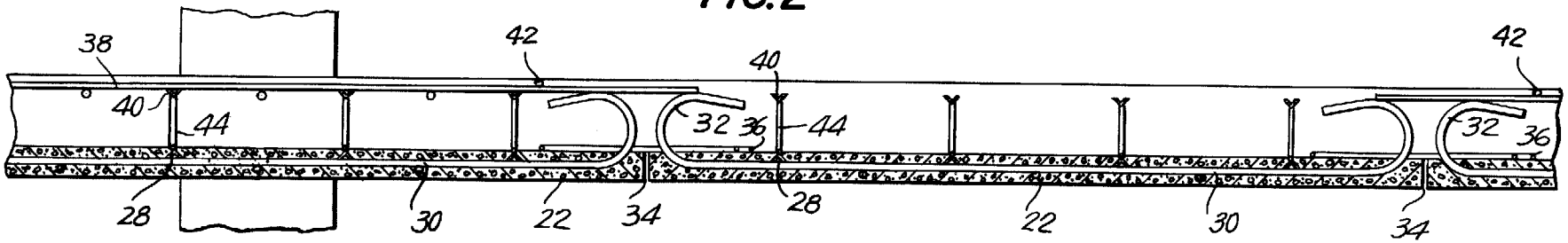
FIG. 2 is a cross-sectional illustration of a reinforced concrete plate construction in accordance with the present invention taken generally in the direction indicated by line 2—2 of FIG. 1 in an intermediate stage of construction.
Figure 3:
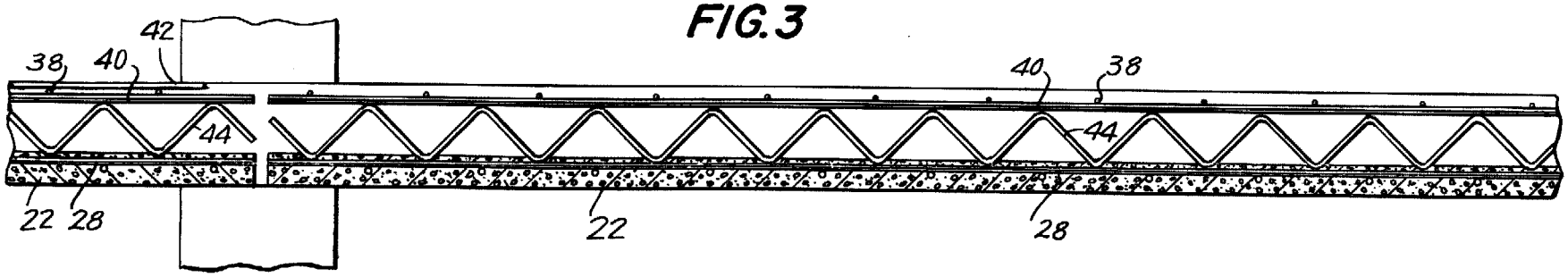
FIG. 3 is a cross-sectional illustration similar to FIG. 2 taken at right angles thereto generally in the direction indicated by line 3—3 of FIG. 1.

With reference now to the drawing, particularly FIG. 1 through 7 thereof, there is shown and illustrated a reinforced concrete structure defining a two-way reinforced concrete slab or "flat plate" fabricated in accordance with the present invention and designated generally by the reference character 20 which comprises a plurality of prefabricated or pre-cast sub-slabs 22 and a cast-in-place monolithic and continuous topping layer 24 cast in place thereon together with reinforcement elements and structures integrated therein and therewith. The sub-slabs 22 comprise only a small percentage of the total thickness of the plate 20 and are typically of sufficient thickness as to have embedded therein all of the lower layer of reinforcement with the upper layer of reinforcement being contained within the topping layer 24.

The reinforcement longitudinal of the sub-slabs 22 may be defined by a series of truss structures 26, the longitudinally extensive lowermost portion or chord 28 being embedded with the sub-slab 22 at the time of fabrication thereof. Transverse reinforcement of the sub-slabs 22 is provided by a series of laterally extending bars 30 also embedded within the sub-slabs 22 at the time of the fabrication thereon. Accordingly, the sub-slabs 22 are reinforced both longitudinally by means of the truss bars 26 and laterally or transversely by means of the bars 30. Upon completion of the slab or plate 20, the truss bars 26 and the transverse bars 30 define the lower reinforcement of the slab 20. To provide for continuity of the transverse reinforcement provided by the bars 30 across the joints between the sub-slabs 22 the endportions of the bars 30 are formed arcuately into hook-shaped portions 32 generally adjacent the side edge portions 34 of the sub-slabs 22 and splicing elements 36 are positioned thereabout and across the joint formed between adjacent edges of the sub-slabs 22 to provide continuity of reinforcement across those joints in a manner to be more particularly described in detail hereafter and provide for tensile capability across said joints.

The sub-slabs 22 may be temporarily shored into position, the splicing elements 36 laid into position and the top transverse steel reinforcement 38 laid across the top members 40 of the trusses 26, top longitudinal reinforcement 42 tied thereto as in conventional concrete construction and the topping layer 24 poured in place to integrate the sub-slabs 22 and the various reinforcing elements into the plate 20 functionally equivalent to a conventionally cast-in-place concrete slab or plate. The sub-slabs 22 not only form the lower surface of the plate 20 but, due to the provision therewithin of the lower reinforcement, linked together by the splice elements 36 for continuity across the joints forms the lowermost portion of the plate 20 and eliminates the necessity for conventional formwork. Only temporary shoring of the sub-slabs 22 until setting of the topping layer 24 is required.

While in the drawing the reinforcement has been shown only sketchily, for clarity, it is to be expressly understood that both the upper and lower reinforcement may be substantially more complex and more extensive than that shown and may be in accordance with any building practice dependent upon the loading and design requirements of the completed plate.

Moreover, while the present invention is of particular utility when applied to two-way reinforced slabs or flat plates, it is to be expressly understood that the present invention is equally applicable to any continuous monolithic span where for convenience or ease of fabrication or transportation it is desirable to integrate two or more sub-slabs of lesser overall dimension than the desired finished structure and it is a particular feature of the present invention that the joints between the sub-slabs or elements may be, in accordance with the present invention, incorporated into a structure without regard to whether at that particular location in the structure there is a positive or a negative bending moment since by use of the splicing of the present invention, the lower reinforcement may be carried continuously across such joints.

The prefabricated panel or sub-slab 22, therefore, in addition to whatever further reinforcing may be required by the specific plate being fabricated, carries one or more of the lattice-type girders or trusses 26 cast into them at the time of making the sub-slab. The lattice webbing 44 and the top chords 40 of the trusses 26 define the height of the truss 26 and is selected so that the truss 26 will be completely embedded in the completed concrete plate 20 when the same is installed and completed on the job and defines the separation between the top and bottom reinforcement. The trusses 26 generally are arranged to run lengthwise of the slab, reinforcing the slab so that they may be made of considerable length and handled in a simple manner without damage in addition to defining the longitudinal reinforcement for the slab 20.

The webbing 44 and top chords 40 of the trusses 26 protrude above the precast sub-slab panel 22 and form reinforcing anchorage for tieing together the precast sub-slab 22 with the poured-on-the-site concrete portion 24, assuring that there will be no slippage between or separation of the layers of the completed composite slab.

The precast panel 22, together with the trusses 26, is designed so that it can be used as formwork with temporary stringers and shores (not shown) spaced far apart (five to eight feet) along its length for adequate transverse support.

The proportions of these precast sub-slabs are chosen to keep them light weight, provide needed cover for the reinforcing bars and to permit trucking of the slabs to the job site. The panel length, as well as the size of the trusses to be employed, will be determined by the requirements of the structure to be built. The width of the panels is generally controlled by the trucking width limitations, usually 8 feet or less, and in some instances, where special trucking permits are obtainable, up to 12 feet. The thickness of the precast panel 10 depends on the size of the reinforcing elements and the protected concrete cover required for the particular job, for practical purposes from 1¼ inches and up.

These precast panels are delivered to the construction site, easily unloaded from the trucks by conventional equipment, such as mobile crane hoists, and erected in place on temporary transverse stringers and shores as mentioned above. Top reinforcing is then added, as necessary, and site concrete is then poured until the required depth is obtained, the webbing and top chord of the trusses now being completely embedded in the poured concrete. After the concrete has set and obtained sufficient strength to carry itself, the shores and stringers are removed, leaving the finished composite floor slab.

The underside of the plate 20 is smooth and free from blemish, eliminating the need for refinishing and plastering prior to decoration of the surface. This will be especially true if the sub-slabs 22 are cast in metal molds or forms. This construction results in a substantial reduction in the overall cost of construction, faster construction, a reduction in the number of men needed on a construction job, as well as a great reduction in the amount of material to be handled, including the elimintion of formwork.

Two-way reinforced concrete slabs or flat plates employ the principle of reinforcing the slab in two transverse direction. Reinforcing in the longitudinal direction of the slabs runs continuously from support to support and is achieved by casting an adequate amount of bars and trusses in the precast sub-slabs.

The reinforcing in the transverse direction is cast into the precast sub-slabs in a length equal to the width of the slabs and by splicing in the field are made continuous. In the present invention, a special method of splicing has been developed which provides an important facet to the economical feasibility of the present system, since these splices occur often and their cost greatly affects the overall cost of the construction job.

In accordance with this invention, this splice may be made by employing special hooks or bends 32 at the ends of the transverse reinforcing bars 30 in conjunction with the splicing elements, members, links 36 which may take many different forms as hereinafter pointed out. The hooked bars 30 are cast into the prefabricated sub-slabs 22 and the splicing members, elements or links 36 may be applied on the job before the concrete topping 24 is poured. The bars to be spliced are cast with their hooked ends 32 positioned upwardly in a vertical plane protruding above the precast sub-slab. The slabs and bars are formed so that the hooked bars in adjacently positioned slabs will be in a predetermined arrangement, preferably with the hook of one slab being directly opposite the hook of the adjacent slab. The splicing is achieved in the field by placing the splice links 36 on top of the precast sub-slabs 22 along the two adjacent hooks and the top concrete is poured to the desired height, embedding the hooks and the link.

After the concrete topping 24 has set and hardened, it locks together the two adjacent hooks 32—32 and the splicing link 36, forming the required transverse reinforcing splice. This type of reinforcing splice is particularly well suited for use in the present construction. It is practical, easy to fabricate and set up, very economical and safe in use. It is also a desired and necessary form of splicing since common lapped reinforcing splicing cannot be safely used in this case and other mechanical connections such as welded reinforcing splices are prohibitively expensive to employ.

Figure 8:
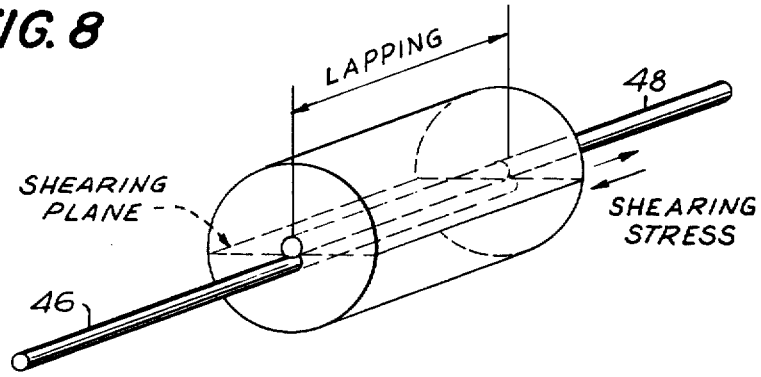
FIG. 8 is a perspective view of an imaginary concrete block with reinforcing rods joined in a conventional locked splice.

The theory and the need for this special splice will be more readily understood once it is understood how a common lapped reinforcing splice works and why it cannot be use for the present construction. Referring to FIG. 8, it will be seen that a common splice of two bars 46 and 48 is achieved by lapping the bars side by side for a determined length and encasing them in concrete. The concrete binds the two bars together by means of bond stress between the concrete and the surface of the bar, and shearing stress of monolithic concrete. We can usually imagine a block of concrete encased around the lapped area of the two lapped bars as shown in this FIG. 8. The strength of such a splice depends on the total bond strength of the bar and the shearing strength of the concrete block along the lapped joint. If we would cut this block along a plane between the bars they will separate together with the halves of the block and no splice will result.

Figure 9:
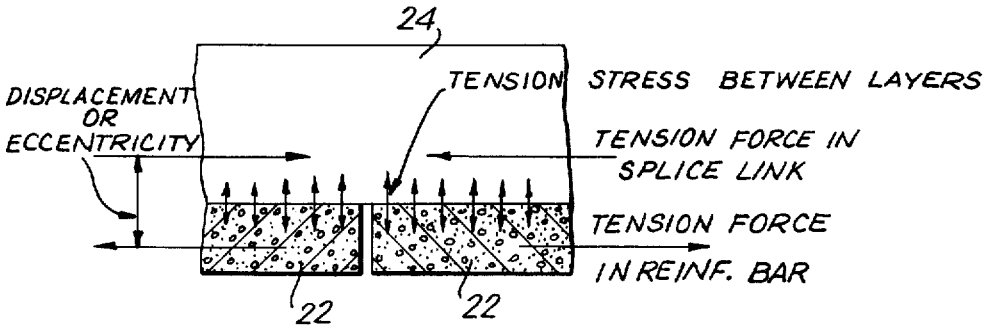
FIG. 9 is a fragmentary sectional view through a composite slab indicating the tension forces and stresses set up in an between the concrete layers.

In the instant construction, the splicing is achieved by having the bar and splice link in two separate layers of concrete joined by natural bond. If a common lapped splice would be used in the present invention, the tension force in the bar will have to be transferred through the contact face of the two layers by bond. Since the structural value of concrete bond is relatively small, and since the displacement of the bar out of the reinforcement plane will cause tension stress to develop between the layers, this will result in the peeling away and the separation of the layers and the failure of the splice. This is illustrated in FIGS. 8 and 9.

It has been heretofore pointed out that the present invention has particular utility in the construction of two-way slabs or flat plates, although the present invention has specific utility even in one-way systems where the span between the support exceeds that which can be precasted or prefabricated and transported to the erection site or location.

By a "one-way system" there is meant a slab supported at its ends and designed to carry a load in one direction. Additionally, such a one-way slab may be supported by beams that frame into girders and columns.

"Two-way Floor Systems", as the name implies, otherwise known as "flat plates" are reinforced to carry a load in two directions, and whether a slab acts as a one-way or two-way slab depends solely on the dimensions of the panels. In a one-way floor slab, there is a high ratio of long to short spans. In a two-way floor system, the ratio of long to short span is 2:1 or less. The span ratio of 2:1 is the usual dividing ratio between one and two-way floors. So the load taken by the longer span of a one-way floor system is less than about 10 per cent of the total load. For the practical purpose it may be assumed that the short beams of a one-way system carries all of the load. In a two-way system, the load is carried to a significant extent in both directions.

Figure 4:
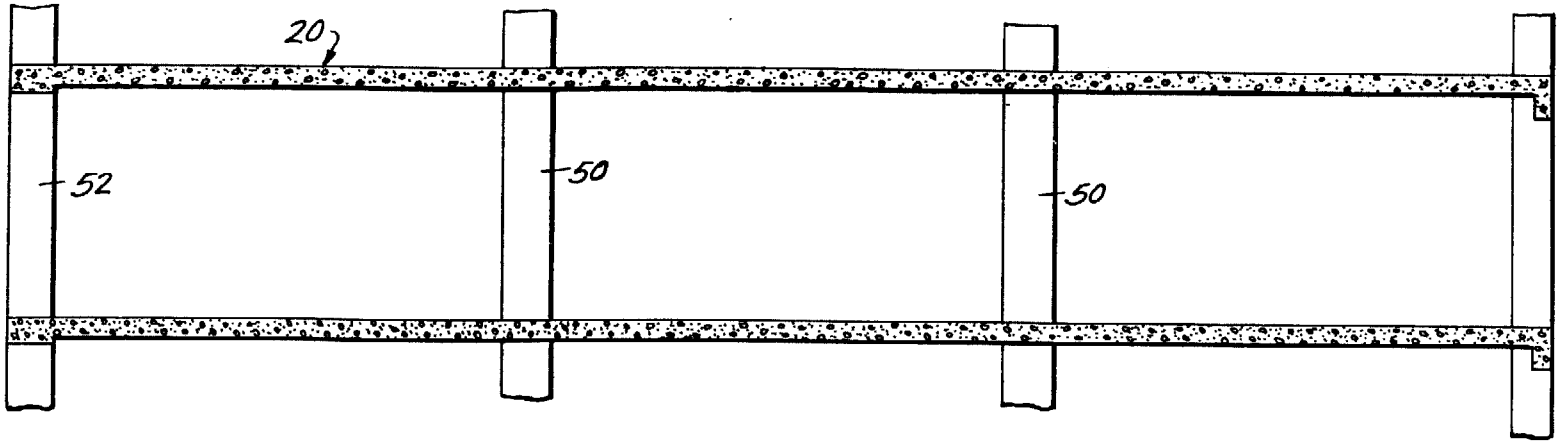
FIG. 4 is a cross-sectional diagrammatic elevational illustration on a reduced scale of a portion of a typical multi-story building utilizing flat plate construction.
Figure 5:
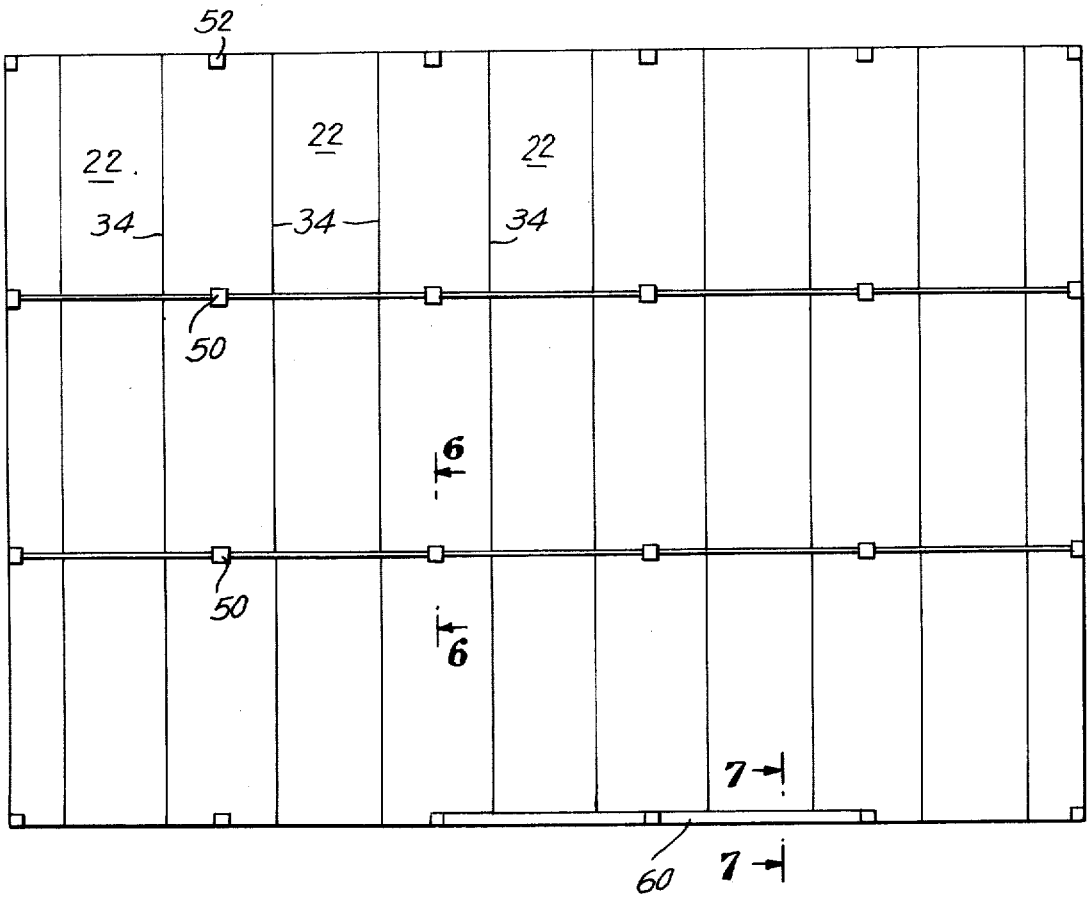
FIG. 5 is a diagrammatic plan illustration on a reduced scale of a typical concrete floor construction layout of sub-slabs for forming a flat plate floor in accordance with the present invention.
Figure 6:
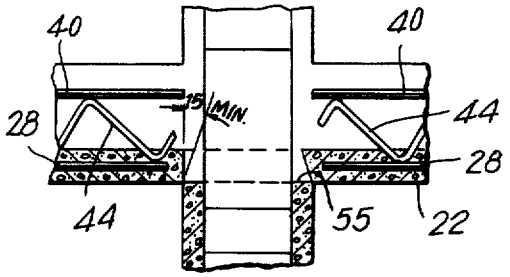
FIG. 6 is a fragmentary sectional view taken along the line 6—6 of FIG. 5.

In FIGS. 4 and 5 there are diagramatically shown a generally typical two-way floor system wherein the distance from column to column in both directions is in the order of 20 feet. In FIG. 4, the composite slab 20 is shown and in FIG. 5 only the sub-slabs 22. Typical dimensions might include interior columns 50 of 2-foot square cross sections and exterior columns, 52 of approximately 18 inch square cross sections. Indicated above, the column to column distance, whether between interior columns 50 or between an interior column 50 and an exterior column 52 would be of the order of 20 feet with a thickness for the slab 20 of approximately 8 inches. Consideration of FIG. 5 and with reference to FIG. 4 will clearly demonstrate that the uppermost portion of the slab 20, in the neighborhood of the columns 50 and 52, is in tension while the layermost portion of the slab 20, in the neighborhood of the columns 50 and 52, is in compression, while the middle span region, that is, in the portion relatively intermediate the columns 50 and 52, the uppermost portion of the slab 20 may be in either compression or tension, while the lower most intermediate portion is always in tension. Accordingly, the lower most portion of the slab 20 is in compression in the neighborhood of the supporting columns 50 and 52, but in tension in the mid-span region. In accordance with the present invention, the sub-slabs has a short span or width substantially smaller than the total span between columns and, accordingly, in the direction transverse the sub-slab longitudinal axis, a joint is present in the intermediate span region — that specific portion of the completed slab 20 which must resist tensile loading. In accordance with the present invention, the reinforcement prefabricated with the sub-slabs 22 are integrated acorss the transverse joint in a special manner, enabling the completed slab to carry tensile loading not only longitudinal thereof but in both directions even in the mid span area or region, and particularly transverse the longitudinal span of the sub-slabs. In other words, in accordance with the present invention, the sub-slabs 22, after integration into the slab 20, by means of the special splices of the present invention are capable of carrying tensile loading in the short span direction across the joints therebetween.

Let us take an average "8" thick flat plate with a basic bottom reinforcing mat of No. 6 reinforcing bar at 12 inches each way and an additional No. 6 at 12 inches in the column strips, to illustrate the extent of the problem involved. The concrete has a compressive strength of 3,000 psi, the steel of 60,000 psi, yield. In order to provide continuity across one layer of steel, the joints where the steel is cut, have to be spliced at the bottom to sustain a tensile force at:

1. $F_1 = 44 \times 60{,}000 - 26{,}400$ lbs per ft. at middle strip;

2. $F_2 = 44 \times 60{,}000 \ \frac{12}{6} - 52{,}800$ lbs per ft. at column strip.

At the same time the top of these joints must sustain an equal force in compression applied to the top 2–3 inches of the slab. The problem is further aggrevated by the fact that in the United States, precast elements are generally 8 feet 0 inches wide, at most, due to the trucking-highway limitations, making it necessary to provide such splicing every 8 feet 0 inches or less and that the tensile and compressive forces may reverse themselves from top to bottom a number of times within the same joint.

Figure 10:
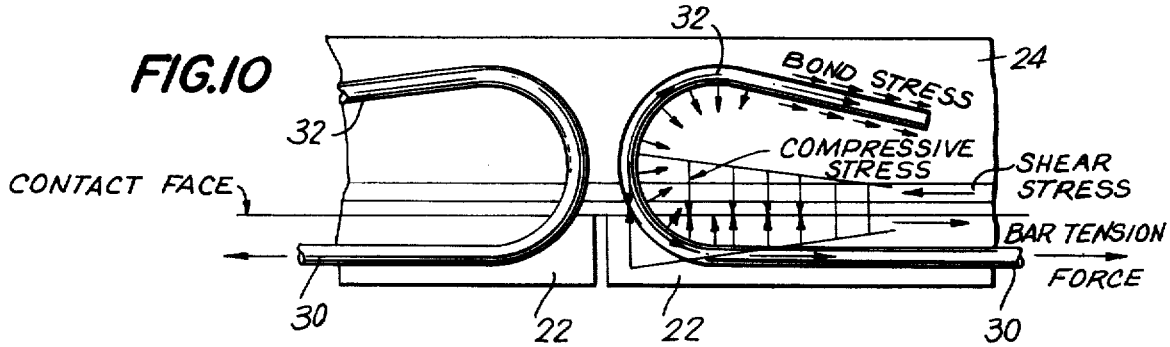
FIG. 10 is a fragmentary section view through a composite slab employing the present invention and indicating the forces present and how they react to the novel splice hereof shown in FIG. 1.

The present splice provides a practical and economical solution to this problem. The hooks 32 at the end of the bars 30 protrude into the upper layer of poured concrete 24 and ties the two layers 22 and 24 together, the tension force in the bar causes compressive stress between the two layers of concrete of a much greater magnitude than the tension stress tending to separate the layers. As shown by the arrows in FIG. 10, the compressive stress increases the bond value between the concrete layers 22 and 24 to such an extent that for all practical purposes the two layers are clamped together, particularly in the vital areas, and act as a monolithic body.

In addition, the hooks transfer the main tension force upward to the splice link away from the tension face of the slab. The splice link is then capable of transferring the forces from bar to bar and provides additional reinforcement needed at the splice.

The reinforcing splice occurs in the block of concrete contained within the splice link. The transfer or anchorage of the tensile force starts when the bar enters this block and is completed by the bar hook in the middle of the block. The splicing link receives this force starting at the end of the block and ending at the center, it either balances the two forces or transfers them.

Figure 11:
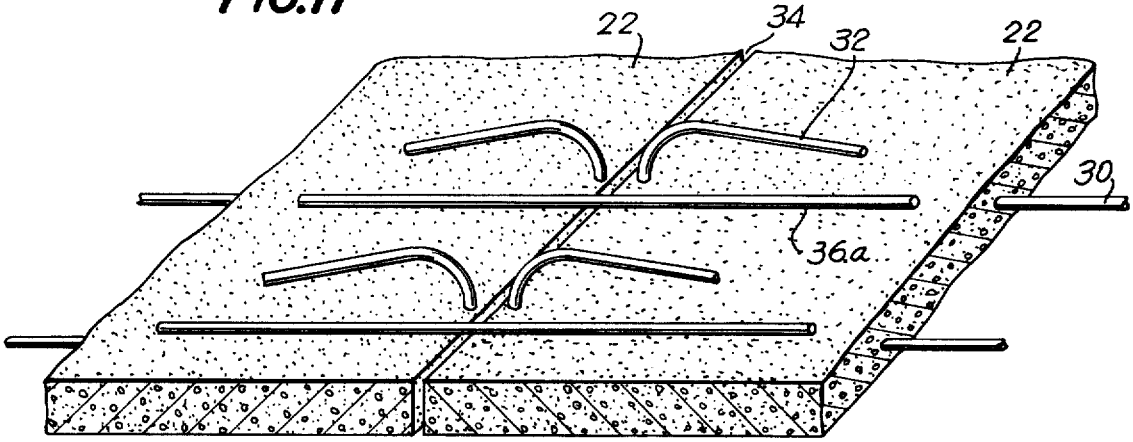
FIG. 11 is an enlarged fragmentary perspective illustration of another splice in accordance with the present invention.
Figure 12:
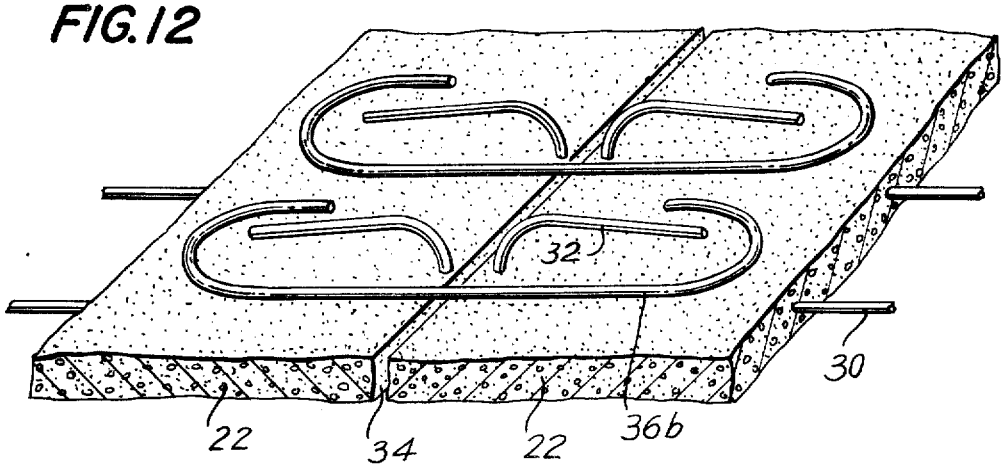
FIG. 12 is an illustration similar to FIG. 11 showing yet another splice in accordance with the present invention.
Figure 13:
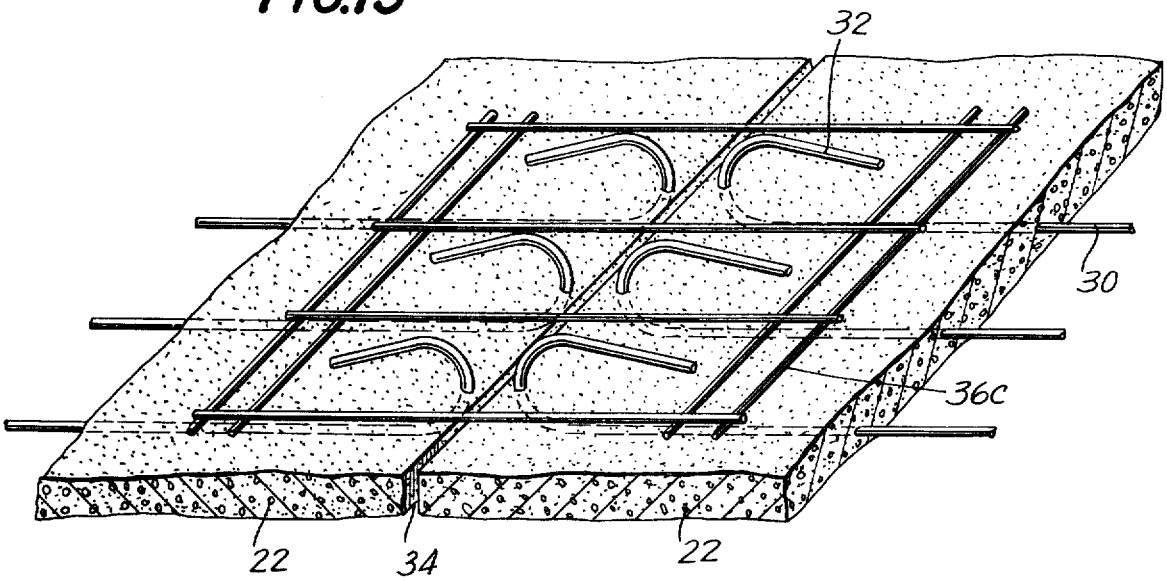
FIG. 13 is a perspective illustration similar to FIG. 11 showing yet still another splice in accordance with the present invention; and, FIG. 14 is a top plan fragmentary view of yet still another splice in accordance with the present invention.
Figure 14:
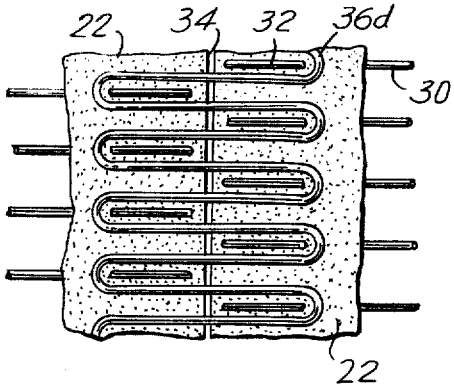

The link can be made in a variety of forms, namely, in the form of an elongated ring 36 shown in FIG. 1, in the form of a straight bar 36*a* shown in FIG. 11, in the form of a hooked bar or link 36*b* shown in FIG. 12, in the form of a welded wire fabric link 36*c* shown in FIG. 13 or in the form of a lacing splice link 36*d* as shown in FIG. 14. In all of these forms, with the exception of the lacing link form, the hooks 32 in adjacent sub-slabs 22 are directly opposite to each other. In the lacing link form of FIG. 12 the bars 30 and hooks 32 are staggered slightly with respect to adjacent panels so as to accomodate the serpentine lacing bar 36*d*.

The bar 30 at each end has the hook 32 preferably formed by bending the end on a relatively true circular arc of at least 180° and preferably somewhat greater, as shown. The diameter of the bend should be at least 3 inches or more depending on the thickness of the composite concrete slab being formed and the return arm should be at least six times the diameter of the bar 30 being used and preferable longer.

It should be noted that in developing the splice, the arrangement is such that it uses the anchorage force to further improve the structural properties of the composite action of the slab. The principle concept of composite construction is to connect precast and poured layers of concrete so that the components act as a unit. The horizontal shear along the contact face is the main stress to accomodate that unit, should a slip occur the structure will fail. When the tensile force in the bar is transmitted through the hook into the top layer of concrete it will compress the two layers and greatly improve the horizontal shear and bond in this area.

Since the magnitude of the tensile force varies in direct proportion to the superimposed load of the structure, it has been found that the structure itself becomes stronger as the loading becomes heavier.

FIGS. 4 and 5 illustrate a practical example of a Wideslab flat slab layout, showing the positioning of the slabs with reference to the main supporting columns 50 and associated transverse beams. In this view the reinforcing is not shown.

In FIGS. 4 and 5 it will be seen that the slabs 10 are laid in place with their ends supported on the line of permanent concrete columns 50. This is shown in section in FIG. 7.

Before the concrete topping is placed over the slabs, service pipes and conduits for electricity, waste water and ceiling heating are positioned on top of the slab. All holes and cut-outs in the floor can be provided in the factory precasting operation or they can be formed in the field.

Figure 7:
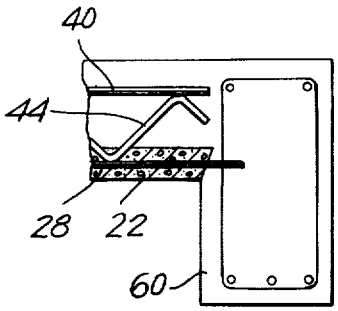
FIG. 7 is a fragmentary sectional view of details taken along line 7—7 of FIG. 5.

Columns 50 supporting the floor above are poured after the slabs on the floor below are in place. For example, referring to FIG. 6, a detail showing a joint at a supporting column 50, a section taken on the line C—C of FIG. 23, the column 50 is formed to the point 55 only, then the sub-slabs 22 are put into the position shown with their ends resting on the column, then the concrete is poured on the slabs and the column then poured and extended to the next floor position above. It will be noted that the precast sub-slabs 22 have their ends formed with an undercut, the preferred undercut being at about 15° from the vertical as shown. It has been determined that shear stress at the supports will be fully developed as in a monolithic slab.

in FIG. 7 a detail is disclosed of a joint between a sub-slab 22 and a horizontal concrete beam 60, an undercut being used here on the panel in similar manner to that described with reference to the supporting column 50.

What is claimed is:

1. A concrete panel suitable for incorporation into a composite concrete two-way slab system, which comprises:

a generally planar relatively thin sub-slab having a generally flat upper surface;

a series of reinforcing bars embedded within said sub-slab and extending transversely substantially entirely thereacross and in a generally parallel alignment with each other;

each of said bars having two end portions and an intermediate portion therebetween;

the intermediate portion of each of said bars being wholly embedded in said sub-slab and lying generally parallel and adjacent to said lower surface;

each of said end portions being bent upward in a continuous curve through an angle of at least 180° with the center point of the bend being above the upper surface of said sub-slab and the lower portion of said continuous curve being embedded in said sub-slab;

the length of the free portion of each of said end portions being equal to at least six times the diameter of the bar; and the height of said bend being sufficient to provide a confined bearing load to concrete filled within the bend in a composite system lower than the allowable confined bearing load of the concrete fill.

2. The panel of claim 1 further comprising a series of reinforcing trusses aligned substantially parallel to each other and generally perpendicular to said reinforcing bars, and with the lower chord of each of said trusses embedded in said sub-slab.

* * * * *

UNITED STATES PATENT AND TRADEMARK OFFICE

CERTIFICATE OF CORRECTION

PATENT NO. : 3,930,348

DATED : January 6, 1976

INVENTOR(S) : Harry H. Wise

It is certified that error appears in the above-identified patent and that said Letters Patent are hereby corrected as shown below:

On the cover of the above patent, reference to the terminal disclaimer has been omitted. The patent should read, following the "Assignee" item [No. 73], --*The portion of the term of this patent subsequent to October 9, 1990, has been disclaimed--

Also, an asterisk (*) should be placed after "[45]" and before the issue date in the upper right hand corner.

Column 7, line 25, "Like reference characters are used throughout the following corresponding parts" should read --Like reference characters are used throughout the following description and the accompanying drawing to designate corresponding parts--.

Column 11, line 35, "acorss" should read --across--

Column 13, line 28, "in" should be capitalized. It is the beginning of a new paragraph.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*

Dedication 3,930,348.—*Harry H. Wise*, Belle Mead, N.J. REINFORCED CONCRETE CONSTRUCTION. Patent dated Jan. 6, 1976. Dedication filed Dec. 28, 1976, by the assignee, *Johns-Manville Corporation.*

Hereby dedicates to the Public the entire remaining term of said patent. [*Official Gazette May 3, 1977.*]